US011270839B2

(12) United States Patent
Wang et al.

(10) Patent No.: US 11,270,839 B2
(45) Date of Patent: Mar. 8, 2022

(54) METHOD OF INCREASING THE COERCIVITY OF A SINTERED ND—FE—B PERMANENT MAGNET

(71) Applicant: Yantai Shougang Magnetic Materials, Inc., Yantai (CN)

(72) Inventors: Chuanshen Wang, Yantai (CN); Zhongjie Peng, Yantai (CN); Kunkun Yang, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 260 days.

(21) Appl. No.: 16/518,387

(22) Filed: Jul. 22, 2019

(65) Prior Publication Data

US 2020/0027655 A1 Jan. 23, 2020

(30) Foreign Application Priority Data

Jul. 20, 2018 (CN) ..... 201810800413.6

(51) Int. Cl.

| | |
|---|---|
| ***H01F 41/02*** | (2006.01) |
| ***H01F 1/057*** | (2006.01) |
| ***H01F 7/02*** | (2006.01) |
| ***H01F 10/00*** | (2006.01) |

(52) U.S. Cl.

CPC ..... *H01F 41/0253* (2013.01); *H01F 1/0577* (2013.01); *H01F 7/021* (2013.01); *H01F 10/005* (2013.01)

(58) Field of Classification Search

None

See application file for complete search history.

(56) References Cited

U.S. PATENT DOCUMENTS

| | | | | |
|---|---|---|---|---|
| 5,068,145 | A * | 11/1991 | Watanabe | G11B 5/7026 428/323 |
| 2010/0282371 | A1* | 11/2010 | Sagawa | H01F 41/005 148/302 |
| 2017/0330659 | A1* | 11/2017 | Mino | C22C 33/02 |

* cited by examiner

*Primary Examiner* — Xiaowei Su

(74) *Attorney, Agent, or Firm* — William H. Honaker; Dickinson Wright PLLC

(57) ABSTRACT

A method of increasing coercivity of an Nd—Fe—B sintered permanent magnet includes a step of providing an organic film. A powder, containing at least one heavy rare earth elements, is uniformly deposited on the organic film forming a diffusion source. Then, a sintered Nd—Fe—B magnet block having a pair of block surfaces extending perpendicular to a magnetization direction is provided. Next, the diffusion source is deposited on at least one of the block surfaces with the powder being in abutment relationship with at least one of the block surfaces. After depositing the diffusion source, the sintered Nd—Fe—B magnet block containing the diffusion source is pressed allowing the powder of the diffusion source to be in close contact with the block surface. The diffusion source is then diffused into the sintered Nd—Fe—B magnet block to produce a diffused magnet block. Next, the diffused magnet block is aged.

16 Claims, 2 Drawing Sheets

METHOD OF INCREASING THE COERCIVITY OF A SINTERED ND—FE—B PERMANENT MAGNET

CROSS REFERENCE TO RELATED APPLICATION

This application claims priority to Chinese Application Serial Number CN201810800413.6 filed on Jul. 20, 2018, the entire disclosure of which is incorporated herein by reference in its entirety.

BACKGROUND OF THE INVENTION

1. Field of the Invention

The present invention generally relates to a method of increasing coercivity of a sintered Nd—Fe—B permanent magnet.

2. Description of the Prior Art

Since its invention in 1983, sintered Nd—Fe—B permanent magnets are widely used in a variety of technologies including, but not limited to, air-conditioners, automobiles, medical instructions, and other industries. Throughout the years, the development of the sintered Nd—Fe—B magnets include making it more compact and thin. At the same time, it also requires improved, e.g. higher, remanence and coercivity.

In the sintered Nd—Fe—B permanent magnets, introducing of heavy rare earth elements such as Terbium, Dysprosium increase the coercivity of the sintered Nd—Fe—B permanent magnets. However, the traditional methods allow Dy or Tb to be introduced into the main phase crystal grains thereby decreasing remanence of the sintered Nd—Fe—B permanent magnets. In addition, the traditional methods also consume large amounts of heavy rare earth elements.

According to the theory of $Nd_2Fe_{14}B$ diffusion, the heavy rare earth elements such as Dy or Tb, diffused through a grain boundary phase, hardens the $Nd_2Fe_{14}B$ main phase forming a large core-shell structure thereby significantly improves the coercivity of the sintered Nd—Fe—B permanent magnet. Accordingly, a large number of techniques have been developed to introduce heavy rare earth elements such as Terbium (Tb), Dysprosium (Dy), a mixture of Tb and Dy, or an alloy containing Tb or Dy into the surface of the sintered Nd—Fe—B permanent magnet via high temperature diffusion and aging treatment to allow the Tb and Dy to be introduced to the $Nd_2Fe_{14}B$ main phase thereby improving the Ha value of the $Nd_2Fe_{14}B$ phase and the coercivity of the sintered Nd—Fe—B permanent magnets.

There are many methods available to conduct a grain boundary diffusion process, such as, but not limited to, vapor deposition, coating, electrophoretic deposition, and electroplating. Vapor deposition processes can effectively improve the coercivity of the sintered Nd—Fe—B permanent magnets, however it has a low production efficiency, high cost, and low utilization rate of heavy rare earth materials. In addition, the vapor deposition process requires using expensive equipment and it is difficult to achieve mass production. Electrophoretic deposition processes have high production efficiency. However, electrophoretic deposition processes deposit a heavy rare earth film on all surfaces of the sintered Nd—Fe—B permanent magnet. Since the surfaces of the sintered Nd—Fe—B permanent magnets need to be polished after the diffusion, the electrophoretic deposition process results in a large waste of the heavy rare earth materials. Additionally, the electrophoretic deposition process results in a large decrease the remanence of the sintered Nd—Fe—B permanent magnets which cannot be used for industrial production. Coating process require mixing the heavy rare earth powder with an organic solvent to form a slurry. Then, the surface of the sintered Nd—Fe—B permanent magnet is coated and dried. After drying, the high temperature diffusion and aging treatments are conducted to increase the coercivity of the sintered Nd—Fe—B permanent magnet. Because the organic solvent is volatile, the ratio of rare earth in the slurry changes overtime. Accordingly, this phenomenon causes the total amount of heavy rare earth deposited on the surface of the sintered Nd—Fe—B permanent magnet to change, resulting in inconsistent magnetic properties after diffusion and aging treatments. In other words, the variation in the magnetic properties of the sintered Nd—Fe—B permanent magnet is excessively large. The electroplating method has high cost, large pollution, complicated process, and the oxidation risk of the plating layer is difficult to be industrialized.

Chinese Patent Applications CN107871602A, CN104299744A teach applying a heavy rare earth hydride on a heat resistant mesh to prepare a diffusion source. Then, the sintered Nd—Fe—B permanent magnet is covered by the diffusion source and the diffusion source is pressed against the sintered Nd—Fe—B permanent magnet. Next, the sintered Nd—Fe—B permanent magnet is subjected to a diffusion treatment. This method has high production efficiency, however, because the heat resistant screen is a high temperature resistant metal or ceramic material, it is difficult to maintain a close contact between the diffusion source and the sintered Nd—Fe—B permanent magnet which would cause uneven diffusion. In addition, such a method requires a coating method to produce a diffusion source, and thus impurities can be introduced in to the sintered Nd—Fe—B permanent magnet and the heavy rare earth content of the diffusion source can be difficult to control which have a large negative impact on the production quality.

SUMMARY OF THE INVENTION

The present invention overcomes the deficiencies mentioned above and provides a method of increasing coercivity of a sintered Nd—Fe—B permanent magnet. The present invention also reduces the amount of heavy rare earth usage during the diffusion process while improves the coercivity of the Nd—Fe—B magnet and the utilization of the heavy rare earth elements. The present invention further prevents impurities from being introduced into the sintered Nd—Fe—B permanent magnet.

It is one aspect of the present invention to provide a method of increasing coercivity of a sintered Nd—Fe—B permanent magnet. The method includes a first step of providing an organic film including a pair of opposing surfaces and having a thickness of between 5 μm and 50 μm. The method proceeds with a step of uniformly depositing, under an inert gas environment, a powder containing at least one heavy rare earth elements on at least one of the opposing surfaces of the organic film thereby forming a diffusion source. Then, the method includes a step of providing a sintered Nd—Fe—B magnet block having a pair of block surfaces, opposite and spaced from of one another, extending perpendicular to a magnetization direction. Next, the method proceeds with depositing the diffusion source on at least one of the block surface of the sintered Nd—Fe—B magnet block with the powder being in abutment relationship with the at least one of the block surfaces. After depositing the diffusion source, the method proceeds with pressing the sintered Nd—Fe—B magnet block containing the diffusion source allowing the powder of the diffusion source to be in close contact with the block surfaces of the sintered Nd—Fe—B magnet block. Then, the diffusion source is diffused into the sintered Nd—Fe—B magnet block under a vacuum environment or an inert gas environment to produce a diffused magnet block. Next, the diffused magnet block is aged under the vacuum environment or the inert gas environment.

It is another aspect of the present invention to provide a method of increasing coercivity of a sintered Nd—Fe—B permanent magnet. The method includes a first step of providing an organic film including a pair of opposing surfaces and having a thickness of between 5 μm and 50 μm. The organic film is selected from at least one of a substrate-less double-sided tape, a one-sided Polyethylene terephthalate tape, a double-sided Polyethylene terephthalate tape, a one-sided Polyvinyl Chloride tape, or a double-sided Polyvinyl Chloride tape. The method proceeds with a step of uniformly depositing, under an inert gas environment, a powder containing at least one heavy rare earth elements on at least one of the opposing surfaces of the organic film thereby forming a diffusion source. Then, the method includes a step of providing a sintered Nd—Fe—B magnet block having a pair of block surfaces, opposite and spaced from of one another, extending perpendicular to a magnetization direction. Next, the method proceeds with depositing the diffusion source on at least one of the block surface of the sintered Nd—Fe—B magnet block with the powder being in abutment relationship with the at least one of the block surfaces. After depositing the diffusion source, the method proceeds with pressing the sintered Nd—Fe—B magnet block containing the diffusion source allowing the powder of the diffusion source to be in close contact with the block surfaces of the sintered Nd—Fe—B magnet block. Then, the diffusion source is diffused into the sintered Nd—Fe—B magnet block under a vacuum environment or an inert gas environment to produce a diffused magnet block. Next, the diffused magnet block is aged under the vacuum environment or the inert gas environment.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Referring to the Figures, wherein like numerals indicate corresponding parts throughout the several views, it is one aspect of the present invention to provide a method of increasing coercivity of a sintered Nd—Fe—B permanent magnet.

Figure 1:
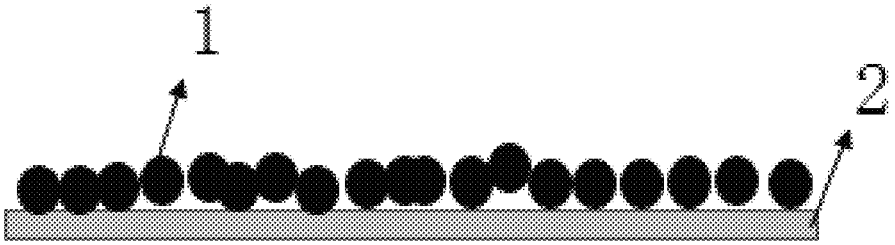
FIG. 1 is a cross-sectional view of a diffusion source according to one embodiment of the present invention.
Figure 3:
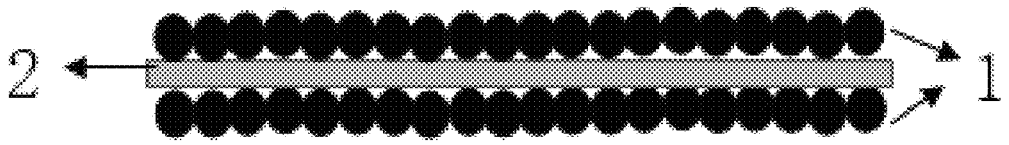
FIG. 3 is a cross-sectional view of another embodiment of the diffusion source according to one embodiment of the present invention.

The method includes a first step of providing an organic film. As best shown in FIGS. 1 and 3, the organic film 2 has a pair of opposing surfaces and has a thickness. Preferably, the thickness of the organic film 2 is between 5μ and 50 μm. According to one embodiment of the present invention, at least one of the opposing surfaces of the organic film 2 can contain an adhesive disposed thereon. According to another embodiment of the present invention, both of the opposing surfaces of the organic film 2 can include the adhesive. Preferably, the organic film 2 is selected from at least one of a substrate-less double-sided tape, a one-sided Polyethylene terephthalate tape, a double-sided Polyethylene terephthalate tape, a one-sided Polyvinyl Chloride tape, or a double-sided Polyvinyl Chloride tape.

Figure 2:
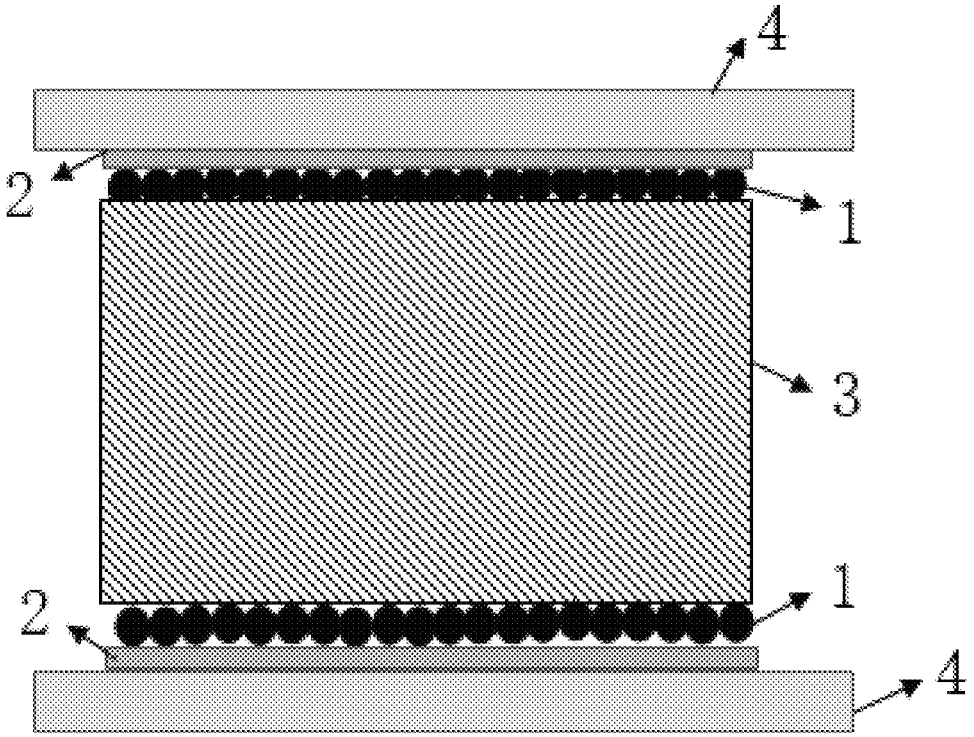
FIG. 2 is a cross-sectional side view of a sintered Nd—Fe—B magnet block including the diffusion source of FIG. 1 pressed between a pair of pressing members.
Figure 4:
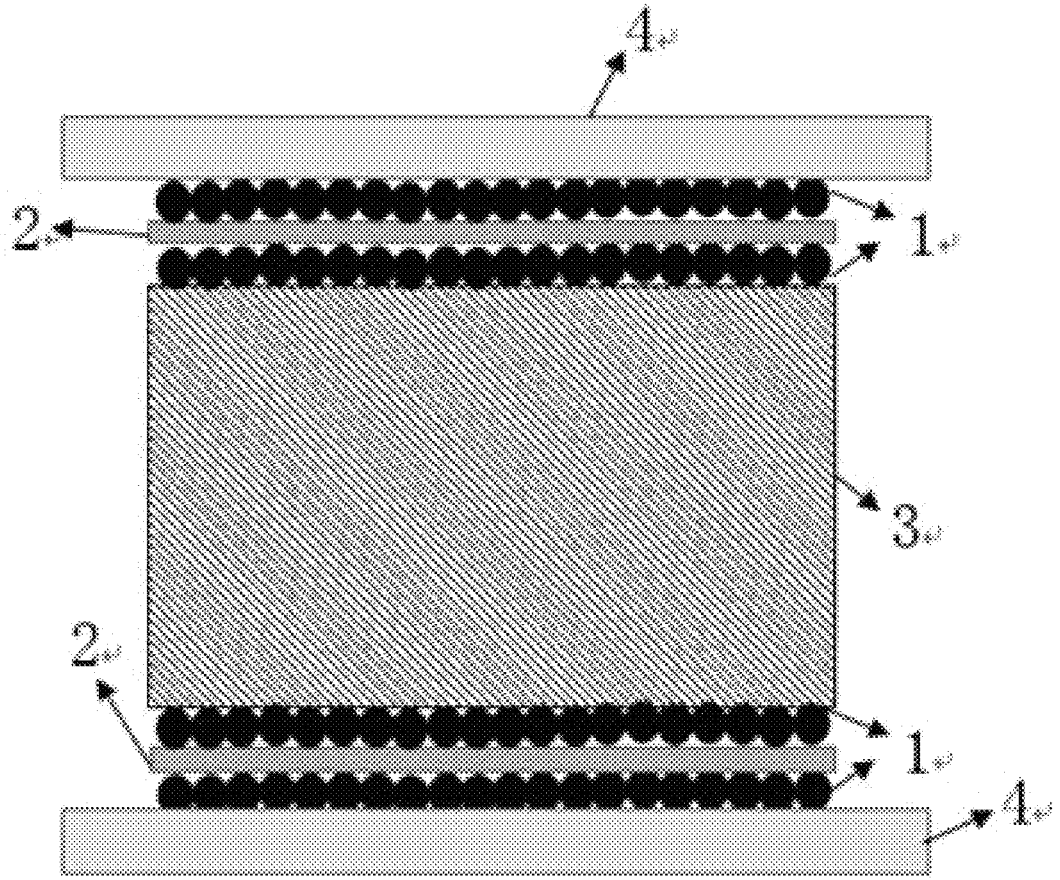
FIG. 4 a cross-sectional side view of a sintered Nd—Fe—B magnet block including the diffusion source of FIG. 4 pressed between the pair of pressing members

As best illustrated in FIGS. 1 and 2, the method then proceeds with a step of uniformly depositing a powder 1 containing at least one heavy rare earth elements, under an inert gas environment, on at least one of the opposing surfaces of the organic film 2. Preferably, the powder 1 is selected from a group consisting of Tb, Dy, a chemical compound containing Tb or Dy, or an alloy containing Tb or Dy thereby forming a diffusion source. In addition, the powder 1 containing at least one heavy rare earth elements has a particle size of between 100 and 500 mesh. It should be appreciated that, according to another embodiment of the present invention, as best shown in FIGS. 3 and 4, the powder 1 can be deposited on each of the opposing surfaces of the organic film 2. In other words, after the uniformly depositing step, the at least one of the opposing surfaces or the opposing surfaces include a thin film of the powder 1 containing the at least one heavy rare earth element.

Next, the method includes a step of providing a sintered Nd—Fe—B magnet block 3 having a pair of block surfaces, opposite and spaced from of one another, extending perpendicular to a magnetization direction. It should be appreciated that the Nd—Fe—B magnet blocks, after sintering, are formed with a preferred magnetization direction. This process can be conducted either by pressing the sintered Nd—Fe—B magnet block 3 in the presence of a magnetic field or undergo a second press that orients the magnetic domains in one direction. In other words, the sintered Nd—Fe—B magnet blocks 3 are magnetized later in the process, long after they are formed. This is because having a single magnetization direction creates a powerful Nd—Fe—B permanent magnet.

The method then proceeds with a step of depositing the diffusion source on the block surfaces of the sintered Nd—Fe—B magnet block 3 with the powder 1 being in abutment relationship with the block surfaces. As best illustrated in FIGS. 2 and 4, after depositing the diffusion source, the sintered Nd—Fe—B magnet block 3 containing the diffusion source is pressed allowing the powder 1 of the diffusion source to be in close contact with the block surfaces of the sintered Nd—Fe—B magnet block 3. It should be appreciated that, according to one embodiment of the present invention, pressing members 4 can be used to press the sintered Nd—Fe—B magnet block 3 containing the diffusion source. Next, the method proceeds with a step of diffusing the diffusion source into the sintered Nd—Fe—B magnet block 3 under a vacuum environment or an inert gas environment to produce a diffused magnet block. Preferably, the step of diffusion is conducted by heating the diffused Nd—Fe—B block containing the diffused source at a diffusion temperature of between 850° C. and 950° C. for a diffusion duration of between 6 hours to 72 hours. After the diffusing step, the diffused magnet block is first cooled, then the method proceeds with a step of aging the diffused magnet block under the vacuum environment or the inert gas environment. Preferably, the step of aging is performed by heating as the diffused magnet block under an aging temperature of between 450° C. and 650° C. for an aging duration of between 3 hours and 15 hours.

Typically, during the diffusion process, heat resistance meshes are used as a medium for receiving the powder containing the at least one heavy rare earth elements to produce the diffusion source. However, the heat resistance meshes are made from metals with high melting points and/or ceramic materials. Accordingly, due to the high heat resistance and the material characteristics, the use of the heat resistance meshes negatively affect the magnetic properties of a sintered Nd—Fe—B magnet block during the diffusion process. For example, because the heat resistance meshes are used, it is difficult to achieve a close contact between the powder containing at least one heavy rare earth elements and the sintered Nd—Fe—B magnet block. As a result, there is an uneven diffusion of the powder into the sintered Nd—Fe—B magnet block. In addition, due to the composition and material properties of the heat resistance meshes, impurities may be introduced into the sintered Nd—Fe—B magnet block during the diffusion process.

For the present invention, the organic film is a thin medium which allows for a more close contact between the powder containing at least one of the heavy rare earth elements and the sintered Nd—Fe—B magnet block. Forming the diffusion source using the organic film also allows the user to control the amount of the heavy rare earth elements that are used during the diffusion process thereby increasing the utilization rate of the heavy rare earth elements. In addition, using the organic film avoids the introduction of slurries or other elements to the powder containing the heavy rare earth elements thereby preventing impurities from being introduced into the sintered Nd—Fe—B magnet block.

The examples below provide a better illustration of the present invention. The examples are used for illustrative purposes only and do not limit the scope of the present invention.

Implementing Example 1

For Implementing Example 1, an organic film having a width of 20 mm and a thickness of 5 μm is provided. The organic film is a double-sided Polyethylene terephthalate tape. Then, a powder containing at least one heavy rare earth element of Terbium is uniformly disposed on each of the opposing surfaces of the organic film, under an inert gas environment, to produce a diffusion source. The powder containing at least one heavy rare earth elements has a particle size of 500 mesh.

A sintered Nd—Fe—B magnet block, having a dimension of 20 mm*20 mm*1 mm(T) and including a pair of block surfaces extending perpendicular to a magnetization direction, is provided. Then, the diffusion source is deposited on the pair of the block surfaces of the sintered Nd—Fe—B magnet block with the powder being in abutment relationship with the block surfaces. After depositing the diffusion source, the Nd—Fe—B magnet block containing the diffusion source is pressed allowing the powder of the diffusion source to be in close contact with the block surfaces of the Nd—Fe—B magnet block.

Next, the sintered Nd—Fe—B magnet including the diffusion source is heated, under a vacuum environment or an inert gas environment, at a diffusion temperature of between 950° C. for a diffusion duration of 6 hours to produce a diffused magnet block. After heating, the diffused magnet block is cooled. Then, the diffused magnet block is subjected to an aging treatment by heating the diffused magnet block under an aging temperature of 500° C. for an aging duration of between 3 hours. The properties of the sintered Nd—Fe—B permanent magnet produced in Implementing Example 1 ("Implementing Example 1") in comparison with the sintered Nd—Fe—B permanent magnet produced without the diffusion process of Implementing Example 1 ("Original") are set forth below in Table 1.

TABLE 1

Magnetic Properties of the Sintered Nd—Fe—B Permanent Magnet Produced in Implementing Example 1 in Comparison with the Sintered Nd—Fe—B Permanent Magnet Produced Without the Diffusion Process of Implementing Example 1

| | Br (KGs) | $H_{cj}$ (KOe) | $H_k/H_{cj}$ |
|---|---|---|---|
| Original | 14.12 | 16.78 | 0.97 |
| Implementing Example 1 | 14.00 | 26.38 | 0.96 |

As illustrated in Table 1 above, after the diffusion process of Implementing Example 1, the remanence (Br) of the original is lowered by 0.12 KGs, the coercivity ($H_{cj}$) is increased by 9.6 KOe, and the squareness ($H_k/H_{cj}$) has a minimal change.

Implementing Example 2

For Implementing Example 2, an organic film having a width of 20 mm and a thickness of 30 μm is provided. The organic film is a double-sided tape. Then, a powder containing at least one heavy rare earth element of Dysprosium is uniformly disposed on each of the opposing surfaces of the organic film, under an inert gas environment, to produce a diffusion source. The powder containing at least one heavy rare earth elements has a particle size of 250 mesh.

A sintered Nd—Fe—B magnet block, having a dimension of 20 mm*20 mm*4 mm(T) and including a pair of block surfaces extending perpendicular to a magnetization direction, is provided. Then, the diffusion source is deposited on the pair of the block surfaces of the sintered Nd—Fe—B magnet block with the powder being in abutment relationship with the block surfaces. After depositing the diffusion source, the Nd—Fe—B magnet block containing the diffusion source is pressed allowing the powder of the diffusion source to be in close contact with the block surfaces of the Nd—Fe—B magnet block.

Next, the sintered Nd—Fe—B magnet including the diffusion source is heated, under a vacuum environment or an inert gas environment, at a diffusion temperature of between 900° C. for a diffusion duration of 10 hours to produce a diffused magnet block. After heating, the diffused magnet block is cooled. Then, the diffused magnet block is subjected to an aging treatment by heating the diffused magnet block under an aging temperature of 450° C. for an aging duration of between 6 hours. The properties of the sintered Nd—Fe—B permanent magnet produced in Implementing Example 2 ("Implementing Example 2") in comparison with the sintered Nd—Fe—B permanent magnet produced without the diffusion process of Implementing Example 2 ("Original") are set forth below in Table 2.

TABLE 2

Magnetic Properties of the Sintered Nd—Fe—B Permanent Magnet Produced in Implementing Example 2 in Comparison with the Sintered Nd—Fe—B Permanent Magnet Produced Without the Diffusion Process of Implementing Example 2

| | Br (KGs) | $H_{cj}$ (KOe) | $H_k/H_{cj}$ |
|---|---|---|---|
| Original | 14.12 | 16.78 | 0.97 |
| Implementing Example 2 | 13.95 | 23.52 | 0.96 |

As illustrated in Table 2 above, after the diffusion process of Implementing Example 2, the remanence (Br) of the original is lowered by 0.17 KGs, the coercivity ($H_{cj}$) is increased by 6.74 KOe, and the squareness ($H_k/H_{cj}$) has a minimal change.

Implementing Example 3

For Implementing Example 3, an organic film having a width of 20 mm and a thickness of 50 μm is provided. The organic film is a double-sided Polyvinyl Chloride tape. Then, a powder containing an alloy of Terbium and Dysprosium is uniformly disposed on each of the opposing surfaces of the organic film, under an inert gas environment, to produce a diffusion source. The powder containing at least one heavy rare earth elements has a particle size of 150 mesh.

A sintered Nd—Fe—B magnet block, having a dimension of 20 mm*20 mm*10 mm(T) and including a pair of block surfaces extending perpendicular to a magnetization direction, is provided. Then, the diffusion source is deposited on the pair of the block surfaces of the sintered Nd—Fe—B magnet block with the powder being in abutment relationship with the block surfaces. After depositing the diffusion source, the Nd—Fe—B magnet block containing the diffusion source is pressed allowing the powder of the diffusion source to be in close contact with the block surfaces of the Nd—Fe—B magnet block.

Next, the sintered Nd—Fe—B magnet including the diffusion source is heated, under a vacuum environment or an inert gas environment, at a diffusion temperature of between 850° C. for a diffusion duration of 72 hours to produce a diffused magnet block. After heating, the diffused magnet block is cooled. Then, the diffused magnet block is subjected to an aging treatment by heating the diffused magnet block under an aging temperature of 600° C. for an aging duration of between 15 hours. The properties of the sintered Nd—Fe—B permanent magnet produced in Implementing Example 3 ("Implementing Example 3") in comparison with the sintered Nd—Fe—B permanent magnet produced without the diffusion process of Implementing Example 3 ("Original") are set forth below in Table 3.

TABLE 3

Magnetic Properties of the Sintered Nd—Fe—B Permanent Magnet Produced in Implementing Example 3 in Comparison with the Sintered Nd—Fe—B Permanent Magnet Produced Without the Diffusion Process of Implementing Example 3

| | Br (KGs) | $H_{cj}$ (KOe) | $H_k/H_{cj}$ |
|---|---|---|---|
| Original | 13.93 | 18.9 | 0.97 |
| Implementing Example 3 | 13.75 | 28.25 | 0.96 |

As illustrated in Table 3 above, after the diffusion process of Implementing Example 3, the remanence (Br) of the original is lowered by 0.18 KGs, the coercivity ($H_{cj}$) is increased by 9.35 KOe, and the squareness ($H_k/H_{cj}$) has a minimal change.

Implementing Example 4

For Implementing Example 4, an organic film having a width of 20 mm and a thickness of 10 μm is provided. The organic film is a one-sided Polyethylene terephthalate tape. Then, a powder containing a Hydride Terbium is uniformly disposed on one of the opposing surfaces of the organic film, under an inert gas environment, to produce a diffusion source. The powder containing at least one heavy rare earth elements has a particle size of 150 mesh.

A sintered Nd—Fe—B magnet block, having a dimension of 20 mm*20 mm*6 mm(T) and including a pair of block surfaces extending perpendicular to a magnetization direction, is provided. Then, the diffusion source is deposited on the pair of the block surfaces of the sintered Nd—Fe—B magnet block with the powder being in abutment relationship with the block surfaces. After depositing the diffusion source, the Nd—Fe—B magnet block containing the diffusion source is pressed allowing the powder of the diffusion source to be in close contact with the block surfaces of the Nd—Fe—B magnet block.

Next, the sintered Nd—Fe—B magnet including the diffusion source is heated, under a vacuum environment or an inert gas environment, at a diffusion temperature of between 900° C. for a diffusion duration of 24 hours to produce a diffused magnet block. After heating, the diffused magnet block is cooled. Then, the diffused magnet block is subjected to an aging treatment by heating the diffused magnet block under an aging temperature of 650° C. for an aging duration of between 10 hours. The properties of the sintered Nd—Fe—B permanent magnet produced in Implementing Example 4 ("Implementing Example 4") in comparison with the sintered Nd—Fe—B permanent magnet produced without the diffusion process of Implementing Example 4 ("Original") are set forth below in Table 4.

TABLE 4

Magnetic Properties of the Sintered Nd—Fe—B Permanent Magnet Produced in Implementing Example 4 in Comparison with the Sintered Nd—Fe—B Permanent Magnet Produced Without the Diffusion Process of Implementing Example 4

| | Br (KGs) | $H_{cj}$ (KOe) | $H_k/H_{cj}$ |
|---|---|---|---|
| Original | 13.93 | 18.90 | 0.97 |
| Implementing Example 4 | 13.70 | 26.12 | 0.96 |

As illustrated in Table 4 above, after the diffusion process of Implementing Example 3, the remanence (Br) of the original is lowered by 0.23 KGs, the coercivity ($H_{cj}$) is increased by 7.22 KOe, and the squareness ($H_k/H_{cj}$) has a minimal change.

In summary, as illustrated in all of the Implementing Examples, the method in accordance with the present invention increases the coercivity of the sintered Nd—Fe—B magnet without reducing the remanence.

Obviously, many modifications and variations of the present invention are possible in light of the above teachings and may be practiced otherwise than as specifically described while within the scope of the appended claims.

These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of increasing coercivity of a sintered Nd—Fe—B permanent magnet, the method including the steps of:

providing an organic film including a pair of opposing surfaces and having a thickness of between 5 μm and 50 μm;

depositing, under an inert gas environment, a powder containing at least one heavy rare earth elements on at least one of the opposing surfaces of the organic film thereby forming a diffusion source;

providing a sintered Nd—Fe—B magnet block having a pair of block surfaces, opposite and spaced from of one another, extending perpendicular to a magnetization direction;

depositing the diffusion source on at least one of the block surface of the sintered Nd—Fe—B magnet block with the powder being in abutment relationship with at least one of the block surfaces;

pressing the sintered Nd—Fe—B magnet block containing the diffusion source allowing the powder of the diffusion source to be in close contact with the at least one of the block surfaces of the sintered Nd—Fe—B magnet block;

diffusing the diffusion source into the sintered Nd—Fe—B magnet block under a vacuum environment or an inert gas environment to produce a diffused magnet block; and aging the diffused magnet block under the vacuum environment or the inert gas environment.

2. The method as set forth in claim 1 wherein at least one of the opposing surfaces of the organic film contains an adhesive.

3. The method as set forth in claim 1 wherein the opposing surfaces of the organic film contain an adhesive.

4. The method as set forth in claim 1 wherein the organic film is selected from at least one of a substrate-less double-sided tape, a one-sided Polyethylene terephthalate tape, a double-sided Polyethylene terephthalate tape, a one-sided Polyvinyl Chloride tape, or a double-sided Polyvinyl Chloride tape.

5. The method as set forth in claim 1 wherein the powder is selected from one of the group consisting of Tb, Dy, a chemical compound containing Tb or Dy, and an alloy containing Tb or Dy.

6. A method of increasing coercivity of a sintered Nd—Fe—B permanent magnet, the method including the steps of:

providing an organic film including a pair of opposing surfaces and having a thickness of between 5 μm and 50 μm;

depositing, under an inert gas environment, a powder containing at least one heavy rare earth elements on each of the opposing surfaces of the organic film thereby forming a diffusion source;

providing a sintered Nd—Fe—B magnet block having a pair of block surfaces, opposite and spaced from of one another, extending perpendicular to a magnetization direction;

depositing the diffusion source on at least one of the block surface of the sintered Nd—Fe—B magnet block with the powder being in abutment relationship with at least one of the block surfaces;

pressing the sintered Nd—Fe—B magnet block containing the diffusion source allowing the powder of the diffusion source to be in close contact with the at least one of the block surfaces of the sintered Nd—Fe—B magnet block;

diffusing the diffusion source into the sintered Nd—Fe—B magnet block under a vacuum environment or an inert gas environment to produce a diffused magnet block; and aging the diffused magnet block under the vacuum environment or the inert gas environment.

7. The method as set forth in claim 1 wherein the powder contains at least one heavy rare earth elements having a particle size of between 100 and 500 mesh.

8. The method as set forth in claim 1 wherein said step depositing is further defined as depositing the diffusion source on the pair of the block surfaces of the Nd—Fe—B magnet block with the powder being in abutment relationship with the block surface.

9. The method as set forth in claim 1 wherein said step of diffusing is further defined as heating the Nd—Fe—B block containing the diffused source at a diffusion temperature of between 850° C. and 950° C. for a diffusion duration of between 6 hours to 72 hours.

10. The method as set forth in claim 1 wherein said step of aging is further defined heating as the diffused magnet block under an aging temperature of between 450° C. and 650° C. for an aging duration of between 3 hours and 15 hours.

11. A method of increasing coercivity of a sintered Nd—Fe—B permanent magnet, the method including the steps of:

providing an organic film including a pair of opposing surfaces and having a thickness of between 5 μm and 50 μm with the organic film being selected from at least one of a substrate-less double-sided tape, a one-sided Polyethylene terephthalate tape, a double-sided Polyethylene terephthalate tape, a one-sided Polyvinyl Chloride tape, or a double-sided Polyvinyl Chloride tape;

depositing, under an inert gas environment, a powder containing at least one heavy rare earth elements on each of the opposing surfaces of the organic film thereby forming a diffusion source;

providing a sintered Nd—Fe—B magnet block having a pair of block surfaces, opposite and spaced from of one another, extending perpendicular to a magnetization direction;

depositing the diffusion source on at least one of the block surfaces of the sintered Nd—Fe—B magnet block with the powder being in abutment relationship with the at least one of the block surfaces;

pressing the sintered Nd—Fe—B magnet block containing the diffusion source allowing the powder of the diffusion source to be in close contact with the at least one of the block surfaces of the sintered Nd—Fe—B magnet block;

diffusing the diffusion source into the sintered Nd—Fe—B magnet block under a vacuum environment or an inert gas environment to produce a diffused magnet block; and aging the diffused magnet block under the vacuum environment or the inert gas environment.

12. The method as set forth in claim 11 wherein the powder is selected from one of the group consisting of Tb, Dy, a chemical compound containing Tb or Dy, and an alloy containing Tb or Dy.

13. The method as set forth in claim 11 wherein the powder contains at least one heavy rare earth elements having a particle size of between 100 and 500 mesh.

14. The method as set forth in claim 11 wherein said step of diffusing is further defined as heating the Nd—Fe—B block containing the diffused source at a diffusion temperature of between 850° C. and 950° C. for a diffusion duration of between 6 hours to 72 hours.

15. The method as set forth in claim 11 wherein said step of aging is further defined heating as the diffused magnet block under an aging temperature of between 450° C. and 650° C. for an aging duration of between 3 hours and 15 hours.

16. The method as set forth in claim 11 wherein said step depositing is further defined as depositing the diffusion source on the pair of the block surfaces of the Nd—Fe—B magnet block with the powder being in abutment relationship with the block surface.

* * * * *